US009146537B2

(12) United States Patent
Cattiau

(10) Patent No.: US 9,146,537 B2
(45) Date of Patent: Sep. 29, 2015

(54) HOROLOGY COMPONENT INTENDED TO HOUSE A DRIVEN-IN MEMBER

(71) Applicant: ROLEX SA, Geneva (CH)

(72) Inventor: Pierre Cattiau, Tavannes (CH)

(73) Assignee: ROLEX S.A., Geneva (CH)

( * ) Notice: Subject to any disclaimer, the term of this patent is extended or adjusted under 35 U.S.C. 154(b) by 0 days.

(21) Appl. No.: 14/256,571

(22) Filed: Apr. 18, 2014

(65) Prior Publication Data

US 2014/0313869 A1 Oct. 23, 2014

(30) Foreign Application Priority Data

Apr. 23, 2013 (EP) ..... 13164838

(51) Int. Cl.

| | |
|---|---|
| ***G04B 37/00*** | (2006.01) |
| ***G04B 31/04*** | (2006.01) |
| ***G04B 13/02*** | (2006.01) |
| ***G04B 15/14*** | (2006.01) |
| ***G04B 17/06*** | (2006.01) |
| ***G04B 17/32*** | (2006.01) |
| ***G04B 29/04*** | (2006.01) |

(52) U.S. Cl.

CPC ..... *G04B 37/0091* (2013.01); *G04B 13/02* (2013.01); *G04B 13/022* (2013.01); *G04B 15/14* (2013.01); *G04B 17/066* (2013.01); *G04B 17/325* (2013.01); *G04B 29/04* (2013.01); *G04B 31/04* (2013.01); *G04B 37/0008* (2013.01)

(58) Field of Classification Search

CPC ..... G04B 17/06; G04B 13/02; G04B 15/14; G04B 17/32; G04B 29/04; G04B 13/021–13/025; G04B 17/066; G04B 31/04; G04B 17/325

See application file for complete search history.

(56) References Cited

U.S. PATENT DOCUMENTS

| | | | | |
|---|---|---|---|---|
| 3,758,172 | A * | 9/1973 | Quaile et al. | 403/291 |
| 2005/0217169 | A1* | 10/2005 | Kunz | 47/33 |
| 2008/0112276 | A1* | 5/2008 | Bitterli et al. | 368/322 |
| 2008/0113154 | A1* | 5/2008 | Bitterli et al. | 428/131 |
| 2008/0197749 | A1 | 8/2008 | Paratte et al. | |
| 2009/0263182 | A1* | 10/2009 | Bannier et al. | 403/242 |

(Continued)

FOREIGN PATENT DOCUMENTS

| | | | |
|---|---|---|---|
| EP | 1921521 | A1 | 5/2008 |
| EP | 2219083 | A1 | 8/2010 |

(Continued)

OTHER PUBLICATIONS

European Search Report for EP 13164838.8, Mailing Date of Nov. 18, 2013.

*Primary Examiner* — Amy Cohen Johnson
*Assistant Examiner* — Matthew Powell
(74) *Attorney, Agent, or Firm* — Westerman, Hattori, Daniels & Adrian, LLP

(57) ABSTRACT

A horology component (14), which has an opening (140) intended to house a member (13) driven into the opening, includes at least one housing structure (15) for housing the member, each housing structure
including a housing element (16) intended to come into contact with the
member, a connecting element
(17), and an elastically deformable element
the (18). The housing element is mounted on the elastically deformable element via the connecting element.

20 Claims, 4 Drawing Sheets

(56) References Cited

U.S. PATENT DOCUMENTS

| | | | | |
|---|---|---|---|---|
| 2010/0061192 | A1* | 3/2010 | Hessler et al. | 368/177 |
| 2011/0080810 | A1* | 4/2011 | Hiraoka et al. | 368/131 |
| 2012/0090933 | A1 | 4/2012 | Conus et al. | |
| 2013/0047437 | A1* | 2/2013 | Daout | 29/896.31 |
| 2013/0176829 | A1* | 7/2013 | Cusin et al. | 368/127 |

FOREIGN PATENT DOCUMENTS

| | | | |
|---|---|---|---|
| EP | 2442189 | A1 | 4/2012 |
| WO | 2013/045706 | A2 | 4/2013 |

* cited by examiner

HOROLOGY COMPONENT INTENDED TO HOUSE A DRIVEN-IN MEMBER

The invention relates to a horology component intended to house a member that is driven in. The invention also relates to an assembly comprising such a component and to a member mounted in or driven into the component. The invention also relates to a movement comprising such a component or such an assembly. The invention finally relates to a timepiece, notably a watch, comprising such a movement or such an assembly or such a component.

Driving an attached jewel into a component (such as a movement blank or a lever for example) is not necessarily easy to do. While driving jewels into movement blanks made of brass is a practice that is known and mastered, the use of other materials, particularly materials that have little or no plastic deformation domain, may prove far more problematical. The use of an elastic geometry is an attractive option in such cases, provided that this structure provides the required resistance to rotational torque and the required resistance to driving out, on the one hand, and a reliable form of assembly on the other.

Various bore geometries that allow two components to be assembled are known, these being particularly suited to materials that have little or no plastic deformation domain. The examples of most frequent use include the driving of staffs into the disks of cog wheels obtained by UV-Liga and the driving of balance staffs into hairspring collets made of silicon.

These geometries provide satisfaction when the required resistance to rotational torque is low and/or when the required resistance to driving out remains low. However, in some cases, for example the case of retaining an inserted jewel in a component, it is found that the ability of the existing solutions to withstand driving out is insufficient. What is more, the known geometries take up a significant amount of space which is not always compatible with the space available for attaching one component to another.

It is an object of the invention to provide a horology component that is able to overcome the aforementioned disadvantages and to improve the horology components known from the prior art. In particular, the invention proposes a horology component that is able to offer significant resistance to the driving-out of a member driven into the component and significant resistance to rotation of the member driven into the component.

The horology component according to the invention is defined by claim 1.

Various embodiments of the component are defined by claims 2 to 11.

The assembly according to the invention is defined by claim 12.

One embodiment of the assembly is defined by claim 13.

The movement according to the invention is defined by claim 14.

The timepiece according to the invention is defined by claim 15.

The attached drawings depict, by way of examples, a number of embodiments of a horology component according to the invention.

Figure 1:
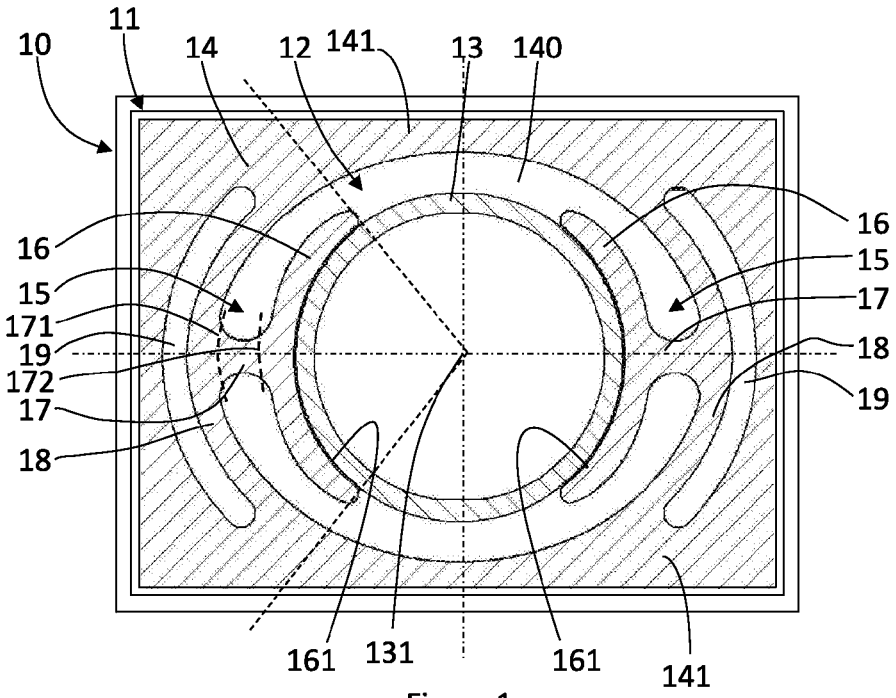
FIG. 1 is a schematic view of a first embodiment of a timepiece including a component according to the invention.

A first embodiment of a timepiece 10 according to the invention is described hereinafter with reference to FIG. 1. The timepiece is, for example, a watch, such as a wristwatch.

The timepiece comprises a horology movement 11. The movement comprises an assembly 12 including a member 13 mounted in, particularly driven into, a horology component 14.

The horology component 14 comprises an opening 140 intended to house the member 13 by the driving of the latter into the opening. The component comprises at least one housing structure 15 for housing the member, in this particular instance two member housing structures 15.

The horology component and the member are depicted in cross section in FIG. 1, particularly in cross section on a plane perpendicular to a direction or axis 131 along which the member is driven into the component.

Each housing structure 15 comprises:

- a housing element 16 intended to come into contact with the member,
- a connecting element 17,
- an elastically deformable element 18.

The housing element is mounted on the elastically deformable element via the connecting element.

For example, the elements form a single piece.

The member preferably takes the form of a cylinder of revolution of axis 131. In FIG. 1, the member is depicted as hollow. Alternatively, it may be solid. The axis passes for example through the center of the opening defined as the center of gravity or barycenter of the opening 140. The opening 140 may for example be of elliptical or substantially elliptical shape.

Advantageously, the horology component has at least several sections that are parallel to one another and perpendicular to the axis 131 and have the same or substantially the same geometry. For example, over the thickness of the component, all the sections may have the same geometry. Alternatively, dimensions of the housing structures, notably thicknesses of the elements, may vary over the thickness of the component.

The housing element of the housing structure may come into contact with the member through the interposition of one or more contact surfaces or via one or more contact points. Advantageously, the surfaces or points of the housing element which are in contact with the member are inscribed on a circle centered on the axis 131 of the member.

The two member housing structures are preferably distributed in the opening. Notably, the two member housing structures are uniformly distributed in the opening, which means to say that the two structures are distributed symmetrically, notably facing one another. The various member housing structures may be identical. The housing structures are separated by rigid parts 141 of the component.

For preference, at least one or some of the housing elements is/are elastically deformable. The housing elements preferably extend orthoradially or substantially orthoradially relative to the axis 131 corresponding to an axis of the member once the member is mounted in the component.

Advantageously, the housing element is stressed at least mainly in bending when the member is introduced into the opening. To do that, the housing element is preferably an element of small thickness (when measured radially) in comparison with its span in contact with the member (in the view in cross section of FIG. 1). Thus, advantageously, the housing element has a shaping that complements or substantially complements a shaping of the member, notably when the member is mounted in the component. Specifically, prior to mounting, the housing element may have a shaping that differs slightly from that of the member so that the housing element is elastically deformed slightly upon contact with the member. It then follows that a contact pressure is applied by at least one surface 161 of the housing element or a contact point to the member at the interface between them. Also, the housing element comprises at least one surface 161. In the case of a member of circular cross section, it is for example possible to provide a housing element of elliptical or substantially elliptical cross section with a minor axis shorter than the diameter of the circular cross section of the member. The deformation of the housing element provides clamping but also allows adaptation to compensate for the spread on the dimensions of the member.

As an alternative, the housing element may comprise a first stop element intended to collaborate as an obstacle with a second stop element of the member in order to prevent the rotation of the member relative to the component in the opening.

The surface 161 of the housing element may extend over an angle of between 60° and 175° around the center of the opening. The surface 161 of the housing element may extend over an angle of around 115° or around 120°. The thickness of the housing element, measured radially relative to the center of the opening, may be comprised between 50 μm and 100 μm of thickness, notably around 70 μm. This is a value that is dependent above all on a form factor dictated by the method of manufacture and by the thickness of the component.

The connecting element is nondeformable or substantially nondeformable. It is therefore dimensioned such that it undergoes practically no deformation when the member is driven in. The connecting element extends radially or substantially radially relative to the axis 131 or to the center of the opening. The connecting element allows the housing element to be mechanically connected or fixed to the elastically deformable element. When the member is set in place in the component, the maximum level of deformation in the connecting element is, for example, 10 times or even 15 times lower than the maximum of the levels of deformation in the housing element and the elastically deformable element.

The connecting element is contained within an angular sector depicted in FIG. 1 and defined by the center of the opening and the extent of the housing element at its interface with the member. For preference also, the connecting element is contained within an angular sector of an angular amplitude that is a factor of two smaller than that represented by the extent of the housing element.

Finally, the elastically deformable element preferably extends orthoradially or substantially orthoradially relative to the center of the opening. It may also extend perpendicular or substantially perpendicular to the direction in which the connecting element extends. This elastically deformable element is formed by the material between the opening 140 and a slot 19 formed within the mass of the component. In this embodiment, the slot is formed concentrically or substantially concentrically with respect to the center of the opening. Thus, the elastically deformable element has a thickness (measured radially relative to the center of the opening) that is constant or substantially constant.

The elastically deformable element is stressed at least mainly in bending when the member is introduced into the opening. Specifically, because of the stressing, the elastically deformable element flexes in the direction of a reduction in the thickness of the slot 19.

The housing element may be distinguished from the connecting element by a boundary 172 and the elastically deformable element may be distinguished from the connecting element by a boundary 171. These distinctions are made for example at the regions where changes in direction of extension of the structure occur, notably where there is a change in direction of extension from radial to orthoradial or a change in direction of extension from orthoradial to radial. Specifically, the housing element extends mainly orthoradially, the connecting element extends mainly radially and the elastically deformable element extends mainly orthoradially. These distinctions are made for example at the regions where variations in the cross-sectional areas of the structure occur, notably where there are significant variations in the cross-sectional areas. These areas are, for example, measured on cylinders of revolution centered on the center of the opening. For example, the boundary 171 is defined by a first cylinder of radius r1 centered on the axis 131, such that the area formed by the intersection between the housing structure and the first cylinder is 50%, even 30%, even 10% less than the maximal area formed by the intersection between the housing structure, notably the housing element, and a cylinder of a radius lower than r1 centered on the axis 131. For example, the boundary 172 is defined by a second cylinder of radius r2 centered on the axis 131, such that the area formed by the intersection between the housing structure and the second cylinder is 200%, even 300%, even 500% greater than the minimal area formed by the intersection between the housing structure, notably the connecting element, and a cylinder centered on the axis 131 with a radius greater than r1.

Alternatively or complementarily, the connecting elements are defined or bounded by a third cylinder of radius r3 centered on the axis 131 and by a fourth cylinder of radius r4 centered on the axis 131, such that, when the member is mounted, the direction of the mechanical loads in the connecting elements are oriented in a radial direction or substantially in a radial direction, i.e. oriented in a direction forming an angle within a range of plus or minus 10°, even plus or minus 5° with the radial direction.

Alternatively or complementarily, one, several or all housing elements extend orthoradially or substantially orthoradially over a distance four times greater, even eight times greater than their radial thickness.

Alternatively or complementarily, one, several, or all connecting element extend radially or substantially radially over a distance equal or substantially equal to their thickness orthoradially measured.

Alternatively or complementarily, one, several, or all elastic deformable elements extend orthoradially or substantially orthoradially over a distance four times greater, even eight times greater than their thickness measured radially.

The horology component may be produced by an electroforming method or by a method of the LIGA type or by a deep etching and photolithography method. It may notably be produced from a fragile material or from Ni or from NiP or from Si or from diamond or from quartz.

The horology component may be a bottom plate or a bridge or a lever or a wheel or a hairspring or a pallet assembly. In other words, the component may or may not be able to move relative to the frame of the timepiece movement.

Thus, the horology component comprises an opening defined by an elastically deformable geometry that is of small size and provides high resistance to driving out, suited in particular to the housing of various types of horology member such as notably a horology jewel, a pin or a staff.

In the case of the driving-in, it is in fact important in certain applications for the resistance to driving out, i.e. the force that opposes the removal of the member from the component along the axis 131, to be high. The geometry described above allows such an objective to be achieved.

As seen in this first embodiment, the two housing structures face one another. They each comprise elastically flexible or deformable elements: the housing element and the elastically deformable element.

The housing element may be viewed overall as a gripper which provides contact with and retention of the member, of concave shape, for example of circular shape, preferably of elliptical shape (in the case of a member of circular or elliptical cross section). The gripper deforms during driving-in and guarantees at least two points of contact per gripper, preferably near the end of the arms of the gripper. The elastically deformable element in this instance is a blade 18, formed between the opening and the slot in the component. The gripper is mounted on this blade. The flexing of this blade allows the gripper to move radially.

The effect of the gripper appears to be secondary in providing the resistance to driving out, but is important in terms of the resistance to rotational torque. The force resisting driving out is provided mainly by the flexible blade. The resistance to driving out and the resistance to rotational torque can thus be optimized almost independently.

For example, the effective clamping of the attached member is typically 25-35 μm, which means that each blade 18 flexes by 12-18 μm.

The ratio of the minimum and maximum dimensions of the outline of the opening is for example around 0.85. The size requirement for the geometry of the opening in one of the directions (along the minor axis of the opening) can be further reduced until it is very near to the diameter of the member.

A second embodiment of a timepiece 20 according to the invention is described hereinafter with reference to FIG. 2.

This embodiment differs from the first embodiment only in that the openings 29 have a different geometry. Specifically, they are a little less extensive. The rigidity of the elastically deformable elements is thereby slightly increased.

Figure 2:
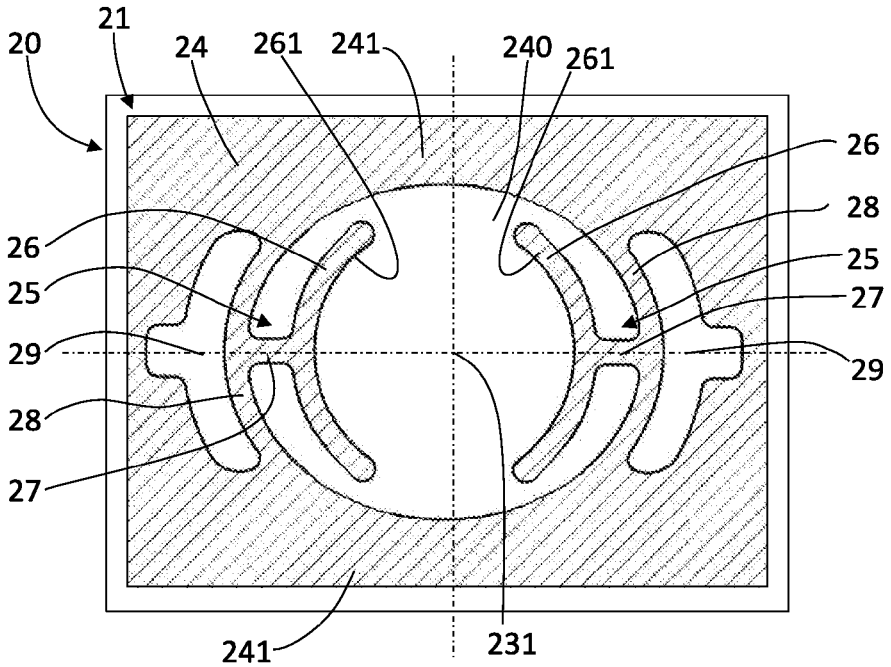
FIG. 2 is a schematic view of a second embodiment of a timepiece including a component according to the invention.

In FIG. 2, elements similar or identical to those of FIG. 1 are identified by a reference the first numeral of which is a "2", whereas it was a "1" in FIG. 1, the other numerals remaining unchanged.

A third embodiment of a timepiece 30 according to the invention is described hereinafter with reference to FIG. 3.

This embodiment differs from the first embodiment only in that the openings 39 have a different geometry. Specifically, they have a different curvature. Thus, the rigidity of the elastically deformable elements is markedly increased. Such an increase in rigidity can be obtained by orienting the slot in such a way as to produce a progressive increase in thickness of the flexible blade 38 toward its ends (for example in order to obtain what is referred to as an isostrain beam).

Such an increase can also be obtained in another way, notably by providing a blade of constant, but greater, thickness.

Figure 3:
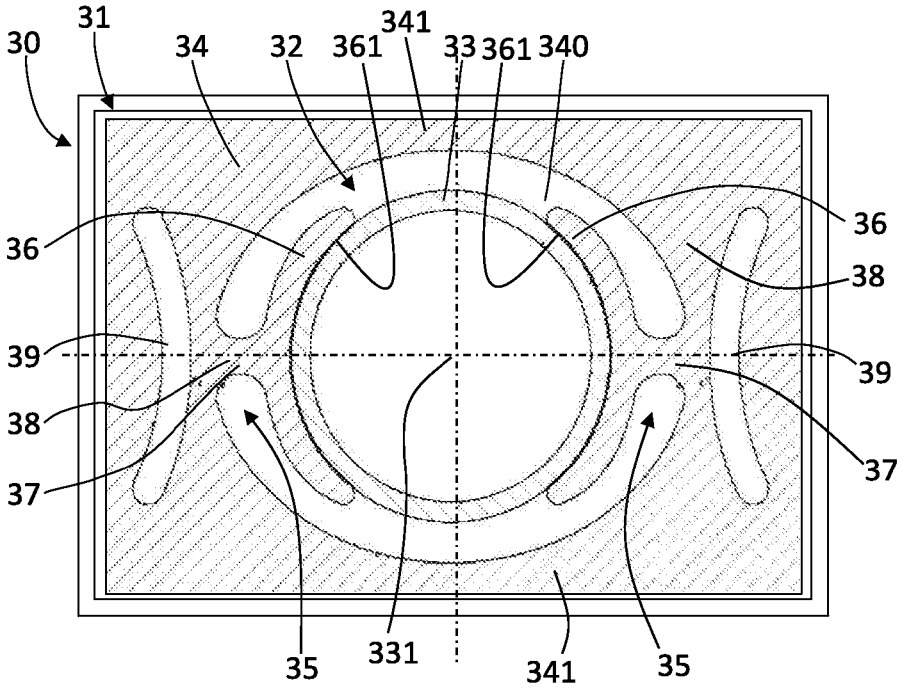
FIG. 3 is a schematic view of a third embodiment of a timepiece including a component according to the invention.

In FIG. 3, elements similar or identical to those of FIG. 1 are identified by a reference the first numeral of which is a "3", whereas it was a "1" in FIG. 1, the other numerals remaining unchanged.

A fourth embodiment of a timepiece 40 according to the invention is described hereinafter with reference to FIG. 4.

This embodiment differs from the first embodiment only in that the connecting elements 47 are produced in the form of two segments or bridges 471 and 472 each extending substantially radially relative to the center of the opening. The two segments are also angularly distant from one another. Thus, relative to the first embodiment, the rigidity of the elastically deformable elements is markedly increased and the rigidity of the housing elements is also markedly increased. Depending on the geometry of the opening, it is possible to influence the rigidities of the housing elements and the rigidities of the elastically deformable elements independently.

Figure 4:
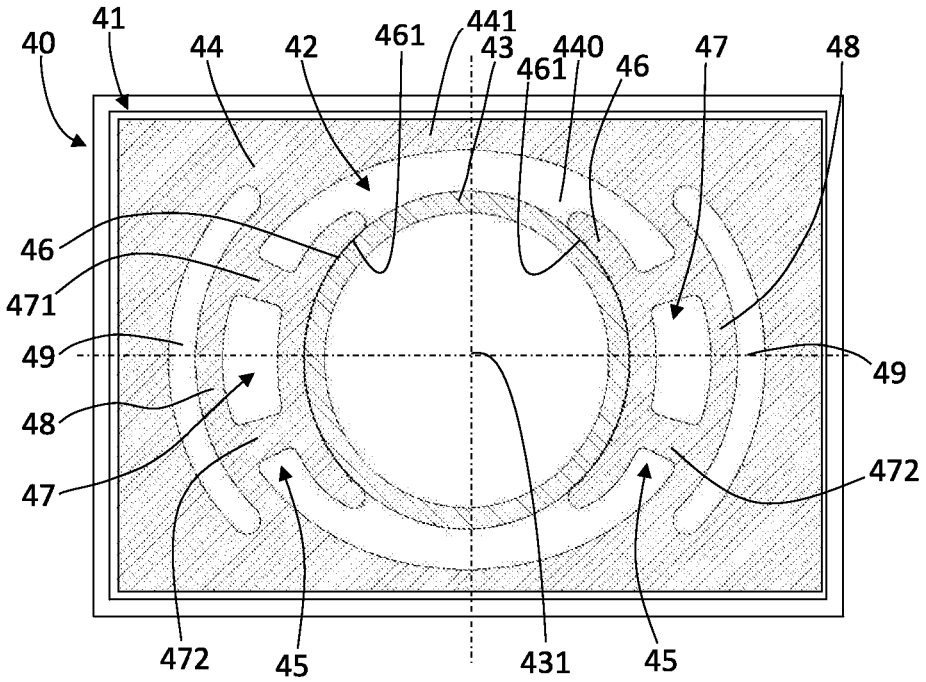
FIG. 4 is a schematic view of a fourth embodiment of a timepiece including a component according to the invention.

In FIG. 4, elements similar or identical to those of FIG. 1 are identified by a reference the first numeral of which is a "4", whereas it was a "1" in FIG. 1, the other numerals remaining unchanged.

A fifth embodiment of a timepiece 50 according to the invention is described hereinafter with reference to FIG. 5.

This embodiment differs from the fourth embodiment only in that the segments or bridges 571 and 572 are still duplicated. Specifically, each of them is made up of a pair of subsegments or sub-bridges referenced 5711, 5712, 5721 and 5722. This also allows the rigidity of the elastically deformable elements and the rigidity of the housing elements to be altered.

Figure 5:
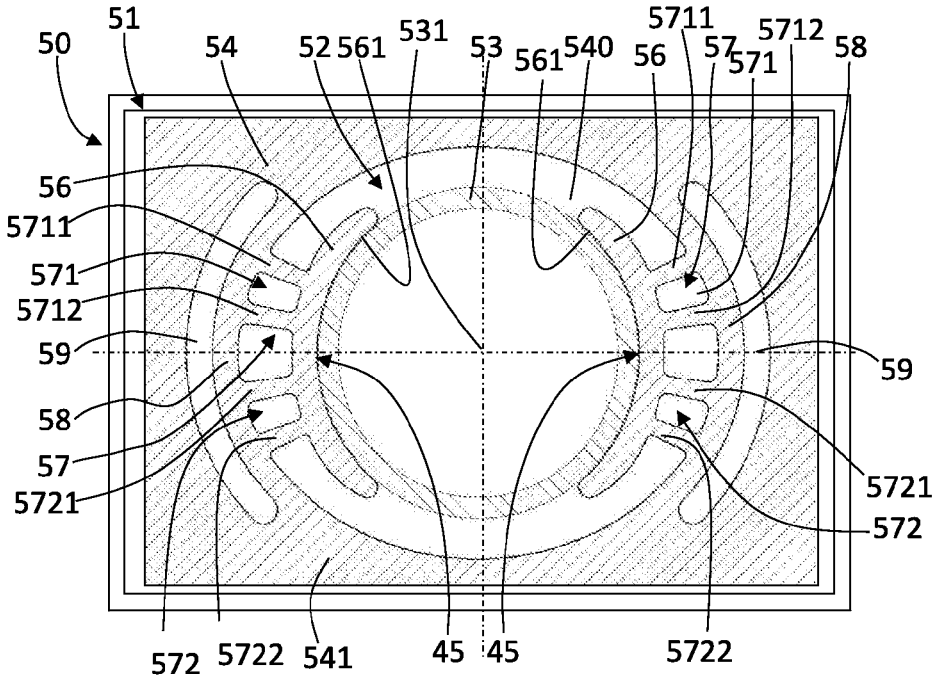
FIG. 5 is a schematic view of a fifth embodiment of a timepiece including a component according to the invention.

In FIG. 5, elements similar or identical to those of FIG. 4 are identified by a reference the first numeral of which is a "5", whereas it was a "4" in FIG. 4, the other numerals remaining unchanged.

A sixth embodiment of a timepiece 60 according to the invention is described hereinafter with reference to FIG. 6.

This embodiment differs from the fourth embodiment only in that the slots 69 are each divided into two slots 691 and 692. Likewise, the elastically deformable elements 68 are each divided into two elastically deformable elements 681 and 682. This likewise allows the rigidity of the elastically deformable elements and the rigidity of the housing elements to be altered.

Figure 6:
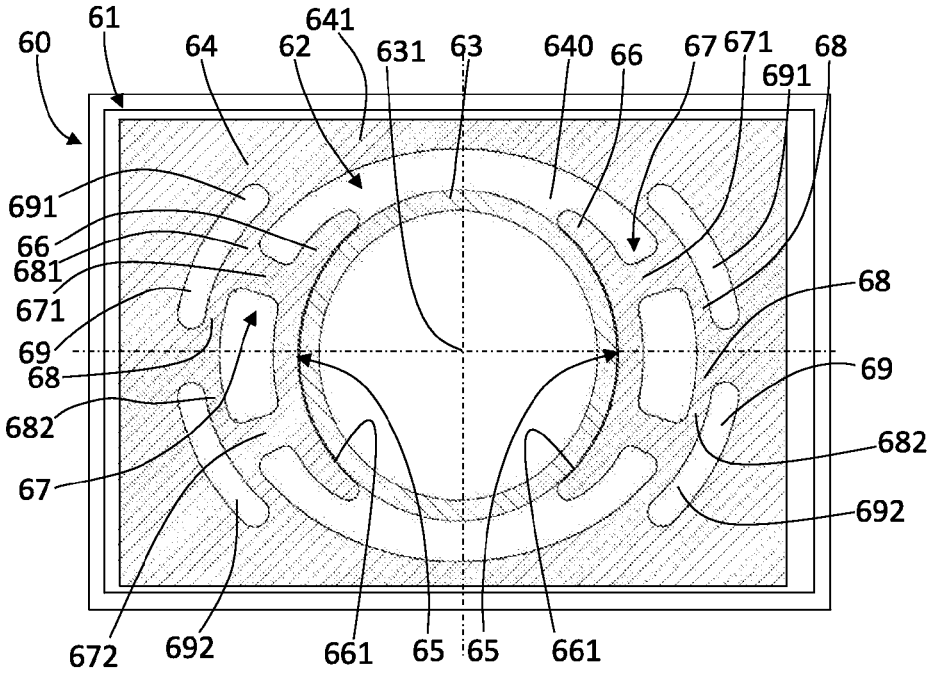
FIG. 6 is a schematic view of a sixth embodiment of a timepiece including a component according to the invention.

In FIG. 6, elements similar or identical to those of FIG. 4 are identified by a reference the first numeral of which is a "6", whereas it was a "4" in FIG. 4, the other numerals remaining unchanged.

A seventh embodiment of a timepiece 70 according to the invention is described hereinafter with reference to FIG. 7.

This embodiment differs from the various preceding embodiments in that the horology component comprises a single housing structure 75, whereas it comprised two of these in each of the preceding embodiments. In this embodiment, any one of the housing structures described hereinabove may be used. In this embodiment, at least one rigid surface is provided in the opening of the component against which rigid surface the member is also to come into contact. This rigid surface may potentially be provided with at least one stop element to prevent the member from rotating relative to the component in the opening.

Figure 7:
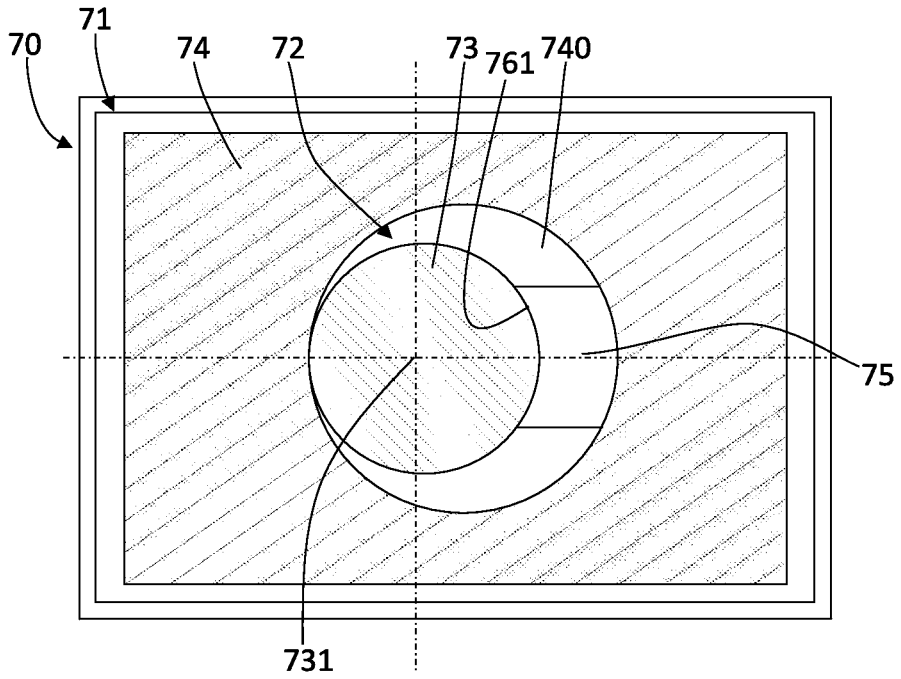
FIG. 7 is a schematic view of a seventh embodiment of a timepiece including a component according to the invention.

In FIG. 7, elements similar or identical to those of FIG. 1 are identified by a reference the first numeral of which is a "7", whereas it was a "1" in FIG. 1, the other numerals remaining unchanged.

An eighth embodiment of a timepiece 80 according to the invention is described hereinafter with reference to FIG. 8.

This embodiment differs from the various preceding embodiments in that the horology component comprises three housing structures 85 whereas it comprised one or two of these in the preceding embodiments. In this embodiment, any one of the housing structures described hereinabove may be used. The various housing structures are preferably identical. However, they may also be of different natures. It is also possible to provide more than three housing structures in the opening, particularly four housing structures.

Figure 8:
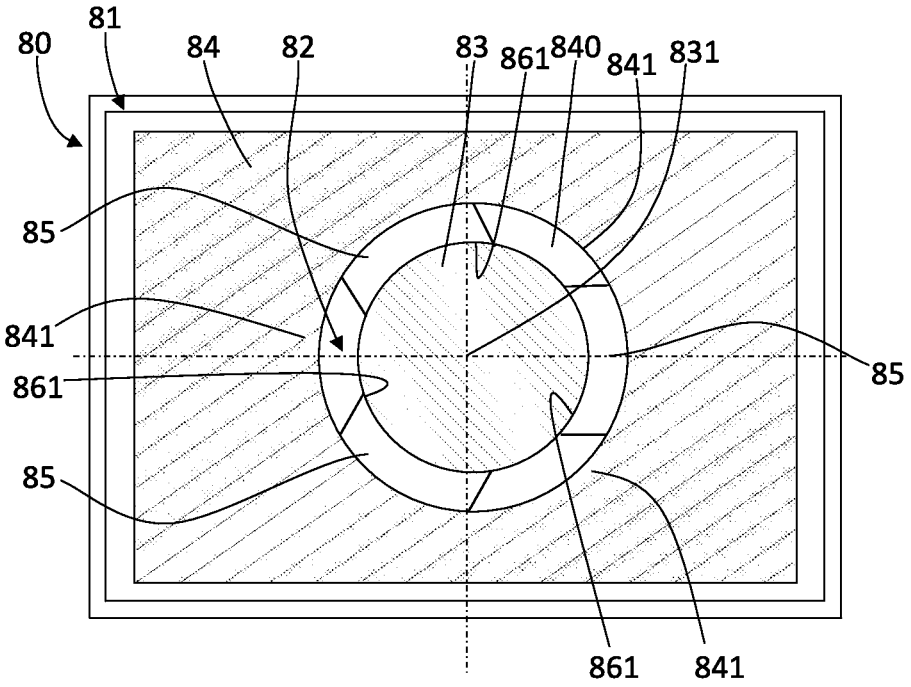
FIG. 8 is a schematic view of an eighth embodiment of a timepiece including a component according to the invention.

In FIG. 8, elements similar or identical to those of FIG. 1 are identified by a reference the first numeral of which is an "8", whereas it was a "1" in FIG. 1, the other numerals remaining unchanged.

In the various embodiments, the dimensions of the various elements may of course be adjusted to account for the mechanical properties of the material used (Young's modulus, maximum elastic stress, etc.).

In addition, the geometries are also adapted to house a member made from a fragile material, i.e. a material that has little or no plastic deformation domain.

As an alternative, it would also be possible to produce an attached member with stop elements, particularly grooves, and to use the shape of the end of the housing elements to form a rotation-preventing stop.

The member is for example a horology jewel, hollow or otherwise, drilled or otherwise, made of a fragile material, notably of ceramic, more particularly of ruby. Of course, the member may be of some other kind, for example a bushing or even a foot screw, made for example of steel or of a copper-based material.

The member preferably is of substantially cylindrical shape. Alternatively, it may have an elongate shape, notably an elliptical shape.

In the various embodiments, the component may include exactly one, exactly two, exactly three, exactly four, exactly five or exactly six housing structures.

The invention claimed is:

1. A horology component comprising an opening having a main axis in a first direction and intended to house a member by the latter being driven into the opening, the component comprising at least one housing structure for housing the member, each housing structure comprising:

an elastically deformable element mounted in the opening and having a main direction of extension within the opening in a second direction, a housing element intended to come into contact with the member, the housing element having a main direction of extension within the opening in a third direction, at a distance from the elastically deformable element, and a connecting element between the elastically deformable element and the housing element, the connecting element having a main direction of extension from the elastically deformable element to the housing element in a fourth direction, the housing element being mounted on the elastically deformable element via the connecting element, wherein:

the second direction is substantially orthoradial to the first direction, the third direction is substantially orthoradial to the first direction, and the fourth direction is substantially radial to the first direction.

2. The horology component as claimed in claim 1 and which comprises at least two housing structures for the member which are distributed in the opening.

3. The horology component as claimed in claim 2, wherein the housing structures are separated by rigid parts of the component.

4. The horology component as claimed in claim 1, wherein the housing element is elastically deformable.

5. The horology component as claimed in claim 1, wherein the housing element is stressed at least mainly in bending when the member is introduced into the opening.

6. The horology component as claimed in claim 1, wherein the housing element comprises at least one contact point intended to come into contact with the member.

7. The horology component as claimed in claim 1, wherein the connecting element is substantially nondeformable.

8. The horology component as claimed in claim 1, wherein the elastically deformable element is stressed at least mainly in bending when the member is introduced into the opening.

9. The horology component as claimed in claim 1, wherein the component is produced by an electroforming method or a LIGA method or a deep etching and photolithography method and/or wherein the component is produced from a fragile material or from Ni or from NiP or from Si or from diamond or from quartz.

10. The horology component as claimed in claim 1, wherein the component is able to move relative to the timepiece movement.

11. An assembly comprising a horology component as claimed in claim 1 and a member mounted in the opening.

12. The assembly as claimed in claim 11, wherein the member is made of a fragile material.

13. A horology movement comprising an assembly as claimed in claim 11.

14. A timepiece comprising an assembly as claimed in claim 11.

15. A horology movement comprising a component as claimed in claim 1.

16. A timepiece comprising a movement as claimed in claim 15.

17. A timepiece comprising a component as claimed in claim 1.

18. The horology component as claimed in claim 1, wherein a cross-section of the connecting element along the first and second directions is smaller than a cross-section of the elastically deformable element along the first and second directions.

19. The horology component as claimed in claim 18, wherein the cross-section of the connecting element along the first and third directions is smaller than a cross-section of the housing element along the first and third directions.

20. The horology component as claimed in claim 19, wherein the housing element is elongated in the third direction and the connecting element is elongated in the fourth direction.

* * * * *